US005111605A

United States Patent [19]

Bossi

[11] Patent Number: 5,111,605

[45] Date of Patent: May 12, 1992

[54] CODING BAND, IN PARTICULAR FOR ELECTRIC CABLES, AND CODING METHOD

[75] Inventor: Daniele Bossi, Milan, Italy

[73] Assignee: Co.E.P.T.E. Costruzioni Elettromec-Caniche per Trazione Elettrica S.r.l., Magenta, Italy

[21] Appl. No.: 440,560

[22] Filed: Nov. 20, 1989

[30] Foreign Application Priority Data

Aug. 9, 1989 [IT] Italy ..... 21480 A/89

[51] Int. Cl.[5] ..... G09F 3/20

[52] U.S. Cl. ..... 40/316; 138/104

[58] Field of Search ..... 40/316, 299, 645, 360, 40/649, 642, 316, 628, 632, 665, 640, 660; 138/104; 174/112; 24/16 R, 17 B, 17 AP

[56] References Cited

U.S. PATENT DOCUMENTS

| | | | |
|---|---|---|---|
| 374,823 | 12/1887 | Burbank | 40/665 |
| 1,563,371 | 12/1925 | Jones | 40/316 |
| 1,896,695 | 2/1933 | Borovicka | 40/645 |
| 2,641,074 | 6/1953 | Richmond | 40/633 |
| 3,467,246 | 9/1969 | Long et al. | 206/56 |
| 4,078,324 | 3/1978 | Wiebe | 40/665 |
| 4,268,986 | 5/1981 | Piana | 40/316 |
| 4,318,234 | 3/1982 | Charles et al. | 40/665 |
| 4,477,950 | 10/1984 | Cisek et al. | 24/17 AP X |
| 4,876,810 | 10/1989 | Piana et al. | 40/316 |

FOREIGN PATENT DOCUMENTS

| | | |
|---|---|---|
| 1851452 | 12/1961 | Fed. Rep. of Germany . |
| 140691 | 3/1980 | German Democratic Rep. . |

*Primary Examiner*—Kenneth J. Dorner
*Assistant Examiner*—J. Bonifanti
*Attorney, Agent, or Firm*—Guido Modiano; Albert Josif

[57] ABSTRACT

This coding band, in particular for electric cables, is provided, proximate to its longitudinal edges, with perforations adapted to be engaged by the traction elements of a computer printer and with a plurality of prepunched strips which extend substantially transversely to the longitudinal extension of the band. The strips delimit regions for printing identification codes for the cables to be tagged, can be individually removed from the band and can be inserted in a seat defined in a supporting element which is associable with at least one cable to be tagged. The strip further defines teeth for its retention in the seat.

4 Claims, 2 Drawing Sheets

CODING BAND, IN PARTICULAR FOR ELECTRIC CABLES, AND CODING METHOD

BACKGROUND OF THE INVENTION

The present invention relates to a coding band, in particular for electric cables, and to a coding method.

As is known, in the implementation of electrical systems it is essential that all the used electric cables be identified in relation to a system diagram so as to facilitate their installation and subsequent interventions for maintenance.

Electric cables are currently identified by using insulating sheaths with different colorings or by using codes composed of numerals and/or letters which are printed directly on the insulating sheaths of the cables or are associated with a supporting element which engages the cables to be tagged.

These kinds of coding for electric cables have some disadvantages.

If the cables are identified by means of a different coloring of the insulating sheaths, considerable diversification problems, as well as the need to provide a considerable number of mutually different sheaths, are in fact encountered when the system to be implemented is complicated and is composed of a large number of cables.

Though it allows to differently mark a very large number of cables, coding performed by printing numerals or letters directly on the insulating sheath of the cables requires the adoption of specific machines which affect, even to a considerable extent, the overall production cost of said cables.

If the coding is performed by means of numerals and/or letters inserted in a supporting element, generally constituted by a tubular body which is closed or open along its lateral surface and has at least two openings, one for the cable or cables to be tagged and one for accommodating the code which identifies said cable, the code is composed manually by inserting individual numerals or letters in succession in the adapted opening; said numerals or letters are printed on small cards and are placed mutually adjacent according to tables supplied to the operator. In this case, the correctness of the coding depends entirely upon the ability and accuracy of the operator and in any case requires relatively long times for execution.

In any case, the composition of the code, whether printed directly on the cable or composed manually, requires relatively long times and all the information related to the wiring to be performed (cable cutting and installation) must be found by the operator in appropriate tables.

SUMMARY OF THE INVENTION

The aim of the present invention is to solve the above described problems by providing a band for coding electric cables or the like which is capable of making extremely simple and rapid the coding operation and the subsequent cable wiring operations.

Within the scope of this aim, an object of the invention is to provide a band which can be used to code cables with the aid of conventional support elements to be associated with the cables.

Another object of the invention is to provide a band for which the possibility of accidental slippages of the codes off the supporting element can be safely eliminated.

Not least object of the invention is to provide a band which allows an extremely precise coding of the cables, eliminating the possibilities of error in composing said codes.

This aim, these objects and others which will become apparent hereinafter are achieved by a coding band, in particular for electric cables, as defined in the appended main claims.

BRIEF DESCRIPTION OF THE DRAWINGS

The characteristics and advantages of the invention will become apparent from the description of a preferred but not exclusive embodiment of the band according to the invention, illustrated only by way of non-limitative example in the accompanying drawings, wherein.

DESCRIPTION OF THE PREFERRED EMBODIMENTS

Figure 1:
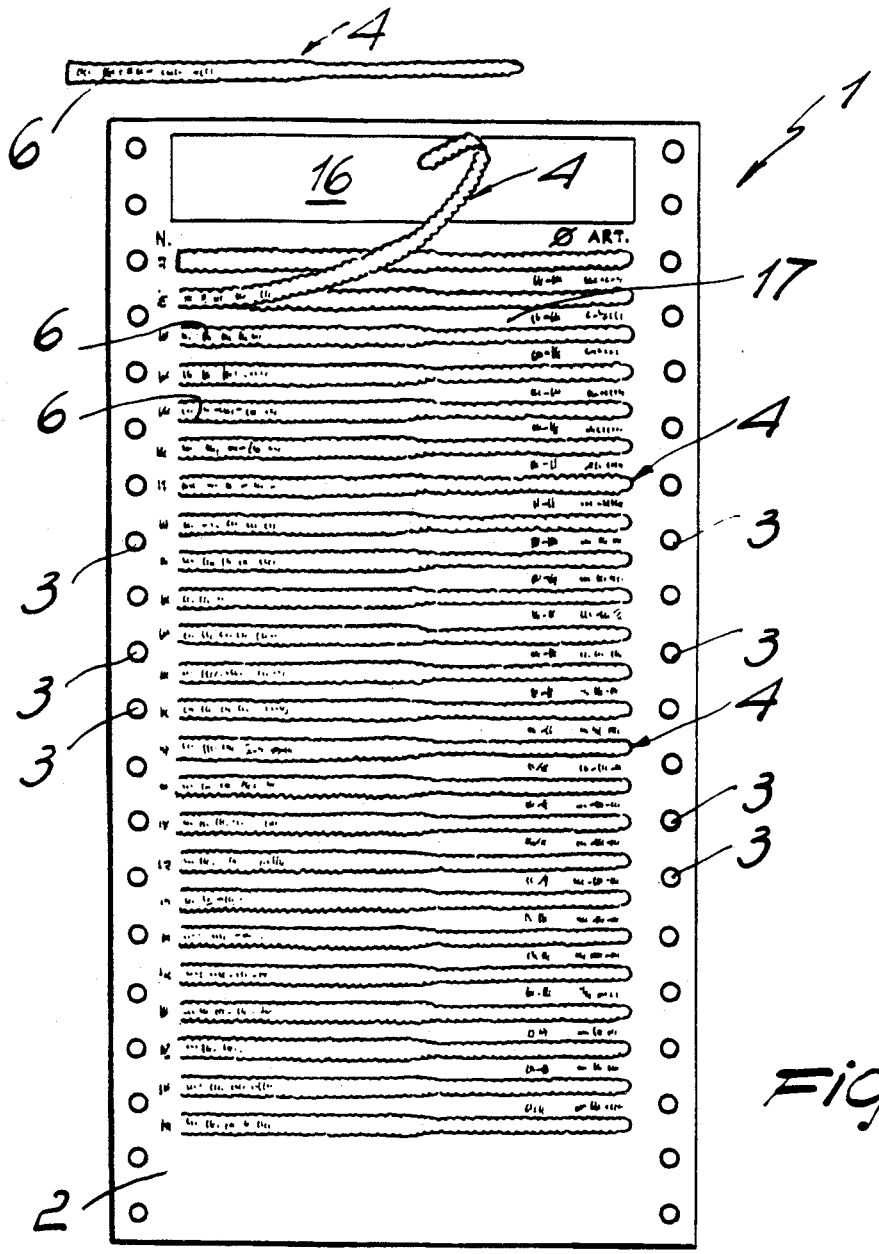
FIG. 1 is a view of a band according to the invention, from which a strip is removed.
Figure 5:
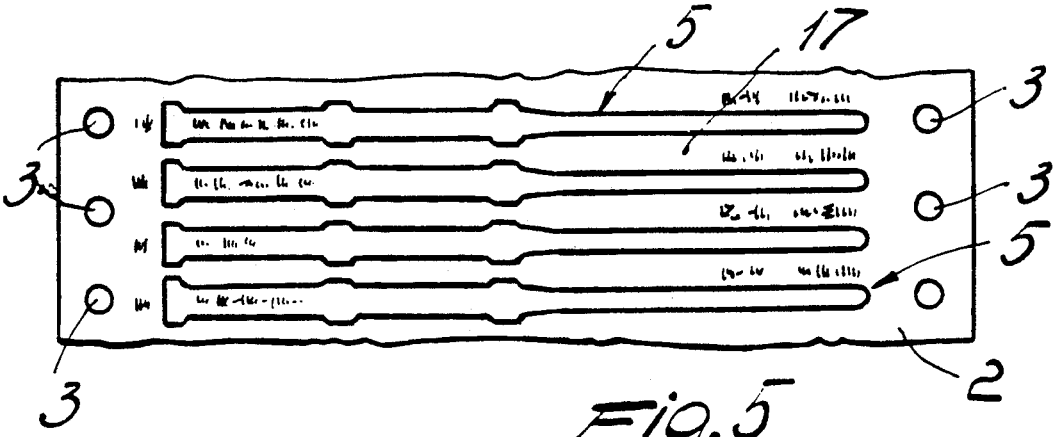
FIG. 5 is an enlarged view of a portion of the band according to the invention, illustrating a variated embodiment of the strips.
Figure 2:
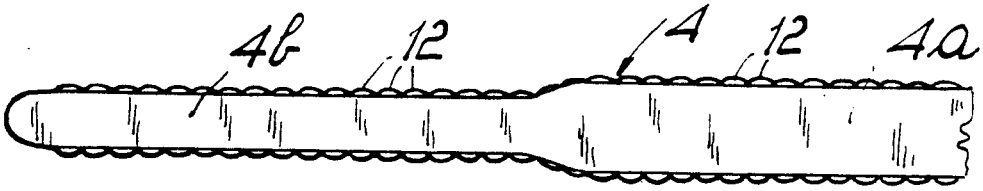
FIG. 2 is an enlarged view of a strip.
Figure 6:
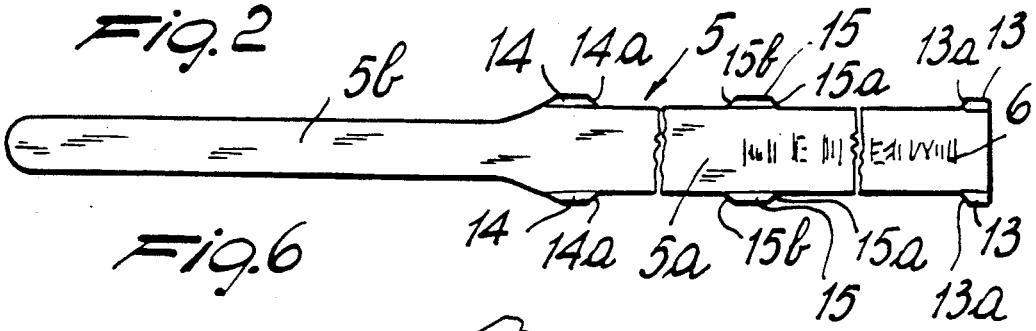
FIG. 6 is an enlarged view of a strip according to the variated embodiment illustrated in FIG. 5.
Figure 3:
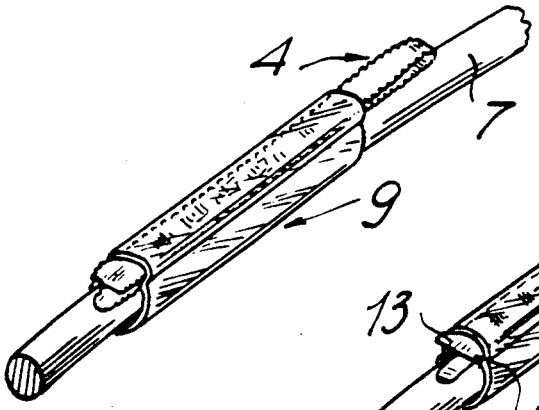
FIG. 3 is a perspective view of a strip of the kind illustrated in FIG. 2 inserted in a supporting element applied to a cable to be marked.
Figure 7:
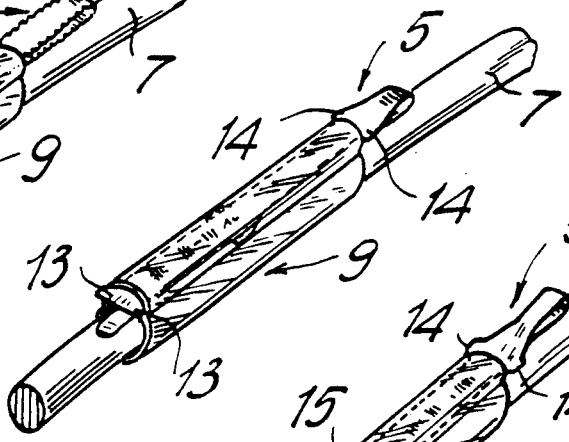
FIGS. 7 and 8 are perspective views of a strip of the kind illustrated in FIG. 6 inserted in a supporting element associated with a cable to be tagged.

With reference to the above described figures, the band according to the invention, generally indicated by the reference numeral 1, substantially comprises a ribbon-like element 2, preferably made of synthetic material, which has, proximate to its longitudinal edges, a plurality of uniformly spaced holes 3 which are intended to be engaged by the traction elements of a known computer printer. A plurality of strips 4, 5 is defined on the band 1 by prepunching; said strips extend along a direction which is substantially transverse to the longitudinal extension of the band 1, and delimit regions on which identification codes 6 for the cables 7 to be tagged are printed preferably after the prepunching of the strips.

Said strips 4 and 5 can be individually removed from the band 1 and can be inserted in a channel-like seat 8 defined in supporting elements 9, for example of a known kind, to be applied to the cables 7 to be tagged.

More particularly, the band 1 has, on its side which is intended to be printed with the cable identification codes, an inking in a color which optically contrasts with the color of the ink used to print the identification codes.

Each strip 4, 5 is furthermore provided with means for retaining it inside the seat 8 of the supporting element 9.

Said supporting element 9 may be constituted, as illustrated, by a tubular body made of transparent material, in which the seat 8 intended to accommodate the strip and a passage 10 for the cable 7 to be tagged are defined in a longitudinal direction and are separated by a dividing wall 11.

Figure 4:
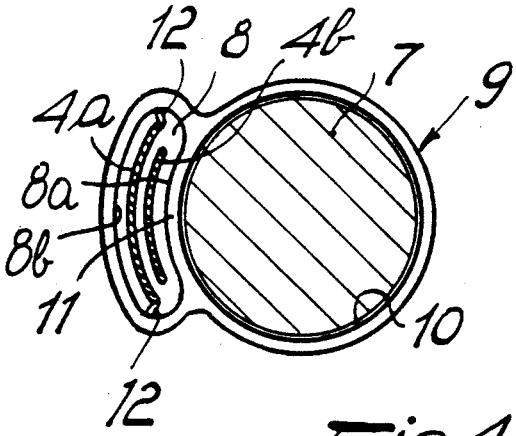
FIG. 4 is an enlarged transverse sectional view of FIG. 3.
Figure 9:
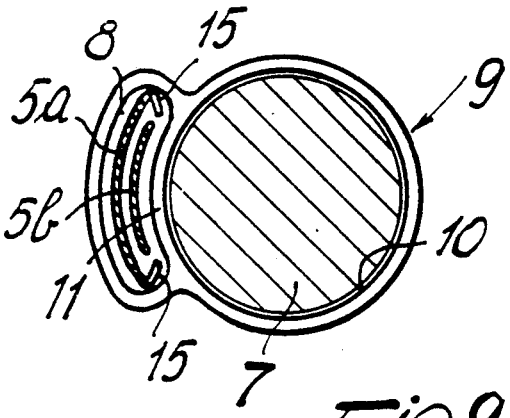
FIG. 9 is an enlarged transverse sectional view of the cable and of the supporting element illustrated in FIG. 7.

As seen in FIGS. 4 and 9, the dividing wall 11 thereby defines an internal partition 8*a* of the seat 8 arranged near the cable 7, and correspondingly the seat 8 has an external partition 8*b* arranged away from the cable 7 opposite to such internal partition.

The strips 4, 5 conveniently have a first portion 4*a*, 5*a* where the codes 6 are to be printed and a second portion 4*b*, 5*b* which extends up to a longitudinal end of the strip and is narrower than the first portion 4*a*, 5*a* so as to extremely facilitate the insertion of the strip inside the seat 8 until the portion 4*a*, 5*a* is moved into said seat.

The means for retaining the strip inside the seat 8 conveniently comprises at least one elastically flexible tooth 12 which protrudes in a transverse direction from at least one of the longitudinal edges of at least the first portion 4*a* and can elastically engage against the inner surface of the seat 8. In the embodiment illustrated in FIGS. 1 to 4, a plurality of teeth 12 is provided along the longitudinal edges of the first portion 4*a* and of the second portion 4*b* substantially for the entire length of the strip.

According to the variated embodiment illustrated in the remaining figures, the retention means are advantageously constituted by at least one pair of transverse projections 13 and 14 which are mutually spaced along the longitudinal edges of the first portion 5*a*. Said projections 13 and 14 define opposite shoulders 13*a* and 14*a* which are mutually spaced by an amount which is at least equal to the length of the supporting element 9 so as to limit, by resting against the longitudinal ends of the supporting element 9, the possibility of longitudinal sliding of the strip inside the seat 8.

At least one intermediate projection 15 is advantageously provided between the pair of projections 13 and 14 and defines a pair of shoulders 15*a*, 15*b* which respectively face the shoulders 13*a* and 14*a* of the projections 13 and 14.

Figure 8:
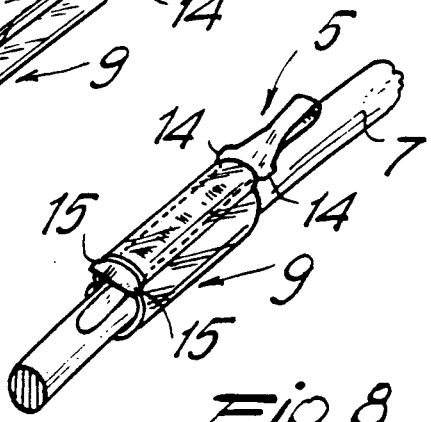

The intermediate projection 15 is conveniently provided when supporting elements 9 with reduced length are used. In this case, the intermediate projection is intended, as illustrated in particular in FIG. 8, to limit the possibility of longitudinal sliding of the strip inside the seat 8 of the supporting element 9, the limited length whereof is substantially equal to, or smaller than, the distance between the shoulders 14*a* and 15*b*. In this case, the identification code is printed on the portion 5*a* between the projections 14 and 15 and the strip is cut between the intermediate projection 15 and the projection 13.

In the illustrated embodiment, the projections 13, 14 and 15 are provided on both longitudinal edges of the portion 5*a*.

Besides the region occupied by the strips 4 and 5, the band 1 has at least one region 16 which is intended to receive, again by printing, auxiliary information which facilitates the operation of coding and wiring the cables, such as for example the type and name of the system to be installed, the progressive page number, or other information, as will become apparent hereinafter.

The strips 4 or 5 are furthermore mutually spaced along the longitudinal extension of the band 1, and further auxiliary information which further simplifies the coding operations, such as for example the cross section of the cable to be tagged or other, may be printed in the interspace 17 provided between two adjacent strips.

The use of the band according to the invention is as follows.

The band 1 is placed in a peripheral printer of a computer and, using an adapted program, the codes 6 to be used are printed on the strips 4 and 5, and all the auxiliary information is printed in the regions 16 and 17 of the sheet which are intended to receive it. The band can then be divided into individual numbered sheets which are placed in an adapted known tray. Each strip 4, 5 is partially separated from the band 1 at its narrower portion 4*b*, 5*b* and inserted in a first end of the seat 8 of the supporting element 9, which is conveniently shorter and has a width which is substantially equal to or slightly greater than the portion 4*a*, 5*a* if the teeth 12 or the projections 13, 14 and 15 are ignored. Then, by pulling portion 4*b*, 5*b* out from the opposite end of the seat 8, the larger portion 4*a*, 5*a* is inserted in the seat 8. In the embodiment illustrated in FIGS. 1 to 4, during the insertion of the strip inside the seat 8 the teeth 12 of the strip flex so as to allow the insertion of said strip in the seat 8 and elastically engage against the inner surface of said seat 8 so as to effectively prevent the accidental slippage of the strip out of the seat 8. As to the embodiment of FIGS. 5 to 9, the strip 5 is inserted in the seat 8, causing the flexing of the projections 14*a* and possibly of the intermediate projection 15, if provided. Once the insertion has occurred, the projection 14 protrudes from the opposite longitudinal end of the seat 8 and at least partially recovers, by elasticity, its original arrangement, and limits, together with the projection 13 arranged at the first longitudinal end of the seat 8, the possibility of accidental slippage of the strip out of the seat 8. The longitudinal sliding of the strip is also limited, in this case, by the elastic engagement of the projection 15, if provided, against the inner surface of the seat 8.

The portion 4*b*, 5*b* is subsequently folded and reinserted, in the opposite direction with respect to the previous one, in the seat 8 below the portion 4*a*, 5*a* so as to further reduce the risk of an accidental slippage of the strip out of the seat 8.

At this point, the supporting elements 9 are ready to be associated with cables 7 which can be easily and exactly identified by using the auxiliary information printed on the band 1.

It should be noted that the strips 4, 5 can be inserted in the seat 8 of the supporting element 9, keeping them coupled to the band 1 at the end of the portion 4*a*, 5*a*, and that they can be removed completely from the band 1 only later on, so as to prevent any possibility of error in coding the cables.

In practice it has been observed that the band according to the invention fully achieves the intended aim, since the coding operation is extremely rapid and precise as the codes can be composed by means of a peripheral printer of a computer.

Another advantage is that the accidental slippage of the strips out of the supporting element during the installation and maintenance operations can be surely avoided.

Not least advantage is that of allowing to memorize and repeat the printing of each individual strip with great precision for a practically unlimited number of times, regardless of the ability of the operator; furthermore, the same program used for coding the cables can perform calculations and groupings which are very useful for determining the required amounts of each component correlated to the wiring operations, both in terms of size assignment and of design of the structures involved.

A further advantage is that of providing the operator, together with the codes with which the cables are to be tagged, with several items of information which make the execution of the work extremely fast, since the band may have printed thereon inscriptions chosen by the user, such as the kind and name of the system, the progressive page number, the cross sections and colors of the cables, their path and their cutting length, the kind and size of the terminals and any other distinguishing and necessary information according to the application.

The band according to the invention, as well as the coding method thus conceived, are susceptible to numerous modifications and variations, all of which are within the scope of the inventive concept; all the details may furthermore be replaced with technically equivalent elements.

In practice, the materials employed, so long as compatible with the specific use, as well as the dimensions, may be any according to the requirements and to the state of the art.

I claim:

1. In combination, an identification strip and a supporting element, said supporting element being attachable in particular to an electric cable which defines a longitudinal extension, said supporting element defining a channel-like seat extending, when said supporting element is attached to said cable, along the longitudinal extension of the cable, said channel-like seat defining an internal partition arrangeable near the cable and an external partition arrangeable away from the cable, said external partition being transparent, said strip defining a first end and a second end, said strip also defining a longitudinal extent which extends from said first end to said second end and a transverse extend which is perpendicular to said longitudinal extent, said strip defining a first portion arranged at said first end and a second portion arranged at said second end, said first portion of said strip defining a region provided with identifying information, said second portion being narrower in said transverse extent than said first portion, said second portion of said strip being slidably inserted into and through said channel-like seat to thereby be a pulling portion for said first portion of said strip, said first portion of said strip being lodged inside said channel-like seat with its said region with identifying information facing said transparent external partition, said strip being bent in a middle portion defined between said first and said second ends thereof and said second portion being folded substantially 180 degrees and reinserted back into said channel-like seat and lodged therein between said first portion of said strip and said internal partition of said channel-like seat.

2. The combination of claim 1, wherein said strip further comprises means for retaining said strip in said channel-like seat, said means for retaining comprising a plurality of elastically flexible teeth which protrude transversely from a longitudinal side of said strip at least at said first portion thereof and which engage with an inner surface of said channel-like seat.

3. Identification strip according to claim 1, further comprising means for retaining said strip in said channel-like seat, said means for retaining comprising at least one pair of transverse projections which are mutually spaced along longitudinal sides of said first portion and which engage with an inner surface of said channel-like seat, said pair of transverse projections defining a pair of opposite shoulders which are mutually spaced by a distance which is at least equal to a length of said supporting element.

4. Identification band according to claim 3, further comprising at least one intermediate projection arranged between said pair of projections which also engages said inner surface of said channel-like seat.

* * * * *